United States Patent [19]

Forbes, II et al.

[11] Patent Number: 4,657,370

[45] Date of Patent: Apr. 14, 1987

[54] BELT SUPPORT AND TRACKING APPARATUS

[75] Inventors: Richard L. Forbes, II, Pittsford; James J. Franzen, Rochester; James A. Solomon, Rochester; Donald J. Weikel, Jr., Rochester, all of N.Y.

[73] Assignee: Xerox Corporation, Stamford, Conn.

[21] Appl. No.: 813,184

[22] Filed: Dec. 24, 1985

[51] Int. Cl.[4] ..... G03G 15/00

[52] U.S. Cl. ..... 355/3 BE; 355/3 R; 355/16

[58] Field of Search ..... 355/3 BE, 16, 3 R, 14 R

[56] References Cited

U.S. PATENT DOCUMENTS

| | | | |
|---|---|---|---|
| 4,218,125 | 8/1980 | Silverberg | 355/3 BE |
| 4,221,480 | 9/1980 | Spehrley, Jr. | 355/3 BE |
| 4,367,031 | 1/1983 | Hamaker | 355/3 BE |
| 4,397,538 | 8/1983 | Castelli et al. | 355/3 BE |
| 4,421,228 | 12/1983 | Marsiglio et al. | 198/814 |
| 4,429,985 | 2/1984 | Yokota | 355/3 BE |
| 4,432,632 | 2/1984 | Yokota | 355/3 DD |
| 4,527,686 | 7/1985 | Satoh | 355/3 BE X |
| 4,551,001 | 11/1985 | Yokota | 355/3 BE |

*Primary Examiner*—A. C. Prescott

[57] ABSTRACT

An apparatus for transporting and tracking a belt arranged to move in a predetermined path and for controlling lateral movement of the belt from the predetermined path comprises a stationary non-rotating arcuate tracking shoe with a belt defining surface for supporting a belt thereon and including vertically oriented flanges at each side of said path defining surface and extending from said path defining surface outwardly to provide belt edge guides. When driving the belt around the tracking shoe the velocity of the belt in the axial direction of the tracking shoe is zero when the belt touches an edge guide. Therefore, the friction force acting on the belt from the tracking shoe in the axial direction approaches zero, thereby helping to keep the total system force applied at the edge guide less than the minimum force necessary to produce buckling of the side of the belt. In a preferred embodiment the belt tracking shoe comprises a first substantially planar path defining surface, an arcuate path defining surface and a second substantially planar path defining surface wherein one of the planar surfaces provides a transfer planten and the arcuate surface provides a copy sheet stripping means in an electrostatographic printing apparatus.

22 Claims, 7 Drawing Figures

10
12
13
14
15
16
17
18
19
20
21
22
24
26
27
28
30
32
34
36
37
38
39
40
42
44
46
47
48
50
52
54

BELT SUPPORT AND TRACKING APPARATUS

REFERENCE TO COPENDING APPLICATION

Reference is hereby made to copending application Ser. No. 358,485, entitled Belt Support and Steering Roller, filed Mar. 15, 1982 in the name of Richard H. Langenheim; to Ser. No. 699,538, entitled Belt Support and Steering Roller filed Feb. 8, 1985 in the name of Richard H. Langenheim and, to Ser. No. 708,202, entitled Belt Support Apparatus, filed Mar. 4, 1985 in the name of James A. Solomon et al.

BACKGROUND OF THE INVENTION

The present invention relates to belt supporting and tracking apparatus and more particularly to apparatus for controlling the lateral movement of the belt from its predetermined path.

In an electrostatographic reproducing apparatus commonly in use today, a photoconductive insulating member is typically charged to uniform potential and thereafter exposed to a light image of an original document to be reproduced. The exposure discharges the photoconductive insulating surface in exposed or back ground areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure.

Many commercial applications of the above process employ the use of the photoconductive insulating member in the form of a belt which is supported about a predetermined path past the plurality of processing stations to ultimately form a reproduced image on copy paper. The location of the latent image recorded on the photoconductive belt must be precisely defined in order to have the various processing stations acting thereon optimize copy quality. To this end it is critical that the lateral alignment of the photoconductive belt be controlled within prescribed tolerances. Only in this manner will a photoconductive belt move through a predetermined path so that the processing stations disposed thereabout will be located precisely relative to the latent image recorded thereon.

When considering control of the lateral movement of the belt, it is well known that if the belt were perfectly constructed and entrained about perfect cylindrical rollers mounted and secured in an exactly parallel relationship with one another, there would be no lateral movement of the belt. In actual practice, however, this is not feasible. Due to the imperfections in the system geometry, the belt velocity vector is not normal to the roller axis of rotation, and the belt will move laterally relating to the roller until reaching a kinematically stable position. Existing methods of controlling belt lateral movement comprise servo systems, crowned rollers and flanged rollers. In any control system, it is necessary to prevent high local stresses which may result in damage to the highly sensitive photoconductive belt. Active systems, such as servo systems employ steering rollers which apply less stress on the belt. However, active systems of this type are generally complex and costly. Passive systems, such as flanged rollers, are less expensive, but generally produce high stresses. Various types of flanged rollers systems have hereinbefore been developed to improve the support and tracking of photoconductive belts. For example, the drive roller may have a pair of flanges secured to opposed ends hereof. If the photoconductive belt moves laterally, and engages one of the flanges, it must be capable of either sliding laterally with respect to the roller system, or locally deforming either itself or the roller system to maintain its position. The edge force required to shift the belt laterally or locally deform itself on the roller system usually greatly exceeds the maximum tolerable edge force. Thus, the belt would start to buckle resulting in failure of the system. Alternatively, the flanges may be mounted on one of the idler rollers rather than the drive roller. Lateral motion is controlled by bending the belt to change the approach angle to the drive roller. A system of this type may develop low edge forces when compared to having the flanges mounted on the drive roller. However, the primary risk associated with this system is that performance depends significantly on the belt bending in its plane. Although the forces in this type of a system are often reduced, they still appear to be unacceptable in that they generally exceed the belt buckling force. Thus, the side edge of the photoconductive belt eventually buckles reducing the lift thereof.

PRIOR ART

Exemplary of the prior art systems are the following disclosures.

U.S. Pat. No. 4,218,125 to Silverberg discloses a neumatic system for supporting the photoconductive surface which uses a pressurized fluid which flows between a belt and at least one support, thereby reducing friction between the belt and the support. The system also employs a tension post 20 which is moved on a spring that is also arranged to pivot at an axis substantially normal to the plane defined by the approaching belt.

U.S. Pat. No. 4,421,228 to Marsiglio et al., discloses a web tracking method which periodically reduces tension on an endless web and adjusts the position of the web. After web tension is reduced, a slight spring force returns the web to a desired lateral position. Marsiglio et al. specifically employs a shaft mounted in a fixed block, one end of which is fixed to a second shaft 44. The compression spring 58 engages the raised portion of the shaft in a block 52 and urges the raised portion into engagement with a lug on one end of a crank member. Spring 34 when compressed, closes the web, engaging portion 32 to adjust the position of the web relative to the rollers.

U.S. Pat. No. 4,221,480 to Spehrley, Jr. discloses a roller having a plurality of spaced flexible disks extending outwardly from the exterior thereof. A pair of opposed, spaced circular flanges are mounted on either end of the roller. The belt passes between the flanges and is supported by the disks on the roller. A plurality of grooves are formed in the disks extending in a direction substantially parallel to the longitudinal axis of the roller. These grooves decouple portions of each disk from one another. As the belt moves in a lateral direction, it engages the flanges. Relative movement of the belt in the lateral direction, deflects the portion of the disk supporting the belt. The remaining portion of each disk, not in engagement with the belt, remains underformed. This ensures that the maximum force applied on the edge of the belt never exceeds the buckling force.

U.S. Pat. No. 4,432,632 to Yokata discloses an apparatus for holding a a recording member in the form of an endless belt. In FIG. 2 Yokata discloses a photosensitive belt with rollers 12 and 13 which support and drive the belt. The roller 12 is pushed outwardly by a spring 33 which is mounted on the support plate 32. The system employed in the spring and support plate pushing outwardly on the roller is disclosed to maintain the belt taut.

SUMMARY OF THE INVENTION

In accordance with the principle aspect of the present invention, apparatus for supporting a belt arranged to move in an endless predetermined path for controlling the lateral movement of the belt from the predetermined path is provided. The apparatus comprises a stationary non-rotating shoe with a belt path defining surface for supporting a belt thereon, the tracking shoe including vertically oriented flanges at opposed sides of the path defining surface extending from the path defining surface outwardly to provide side edge guides. Preferably the arcuate belt tracking shoe has in the process direction, a first substantially planar path defining surface, an arcuate path defining surface, and a second substantially planar path defining surface to enable the belt to be reversed in direction when being transported therearound.

In a further aspect of the present invention, the belt tracking shoe is a smooth hard surface with a low coefficient of friction and the vertically oriented flanges are crescent shaped extending from the path defining surface substantially only on the portion of the belt tracking shoe which changes belt direction.

In a further aspect of the present invention, apparatus for transporting and tracking a belt arranged to move in an endless predetermined path and for controlling lateral movement of the belt from a predetermined position, comprises at least one rotatably driven belt transport roll, a belt tracking means, an endless belt arranged to move in a predetermined path around the rotatably driven support roll and the belt tracking means, wherein during movement of the belt by the drive roll around the tracking shoe the velocity of the belt in the axial direction of the tracking shoe is zero when the belt touches an edge guide and the friction force driving the belt toward the edge guide in the axial direction approaches zero.

Pursuant to another aspect of the present invention, electrostatographic printing apparatus of the type having an endless photoconductive belt arranged to move in a predetermined path past the plurality of process stations is provided, wherein one of the planar path defining surfaces, the belt tracking shoe is adjacent to the toner image transfer zone and provides a transfer platen and the arcuate path defining portion provides means to strip the copy sheets from the photoconductive belt.

Other features of the present invention will become apparent as the following description proceeds and upon reference to the drawings.

DESCRIPTION OF THE PREFERRED EMBODIMENT

The invention will now be described with reference to the preferred embodiment of the belt tracking shoe in electrostatographic apparatus employing same.

Figure 1:
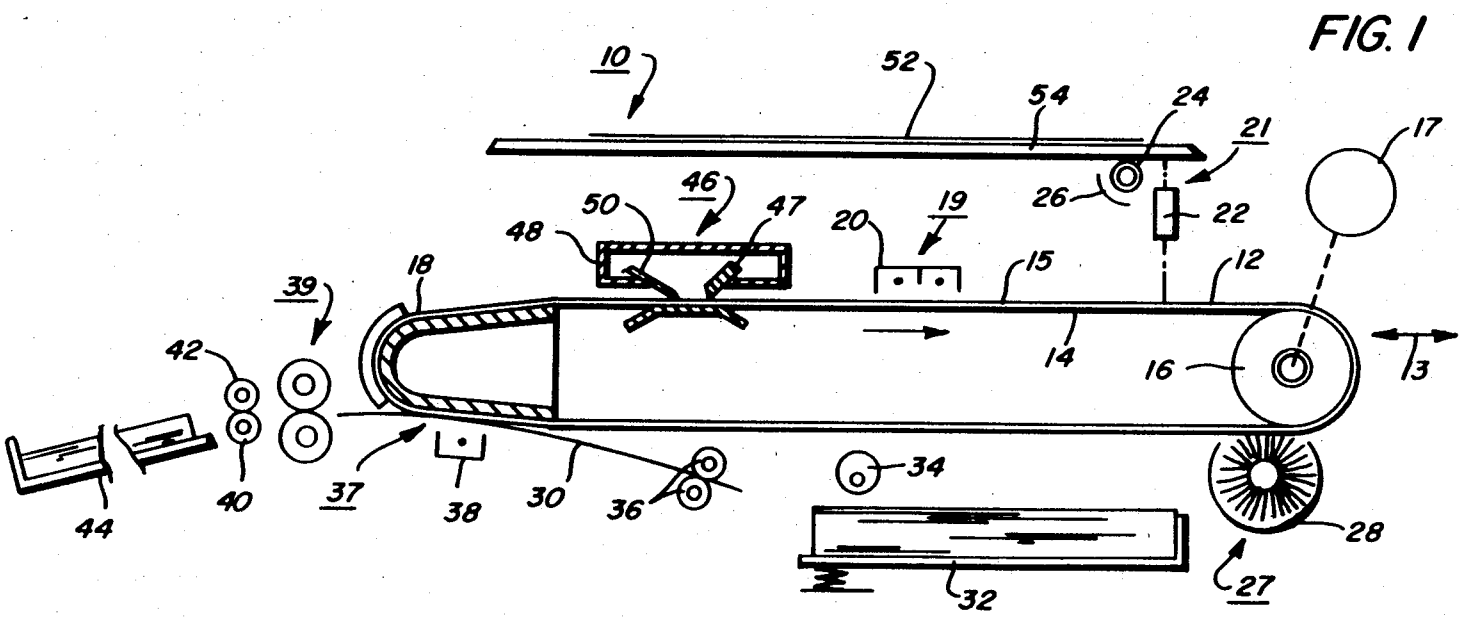
FIG. 1 is a schematic representation in cross section of an automatic electrostatographic reproducing machine with the belt tracking shoe according to the present invention included therein.
Figure 2:
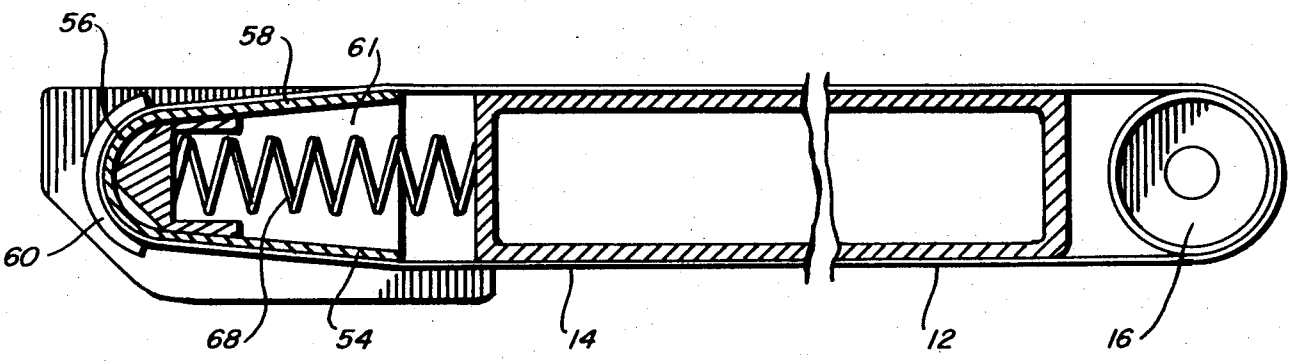
FIG. 2 is an enlarged view of the photoreceptor cartridge of FIG. 1 showing in cross section further details of the belt tracking shoe.

Referring now to FIG. 1, there is shown by way of example, an automatic electrostatographic reproducing machine 10 which includes a removable processing cartridge employing the belt tracking shoe according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment or embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around belt tracking shoe 18 and travels in the direction indicated by the arrows on the inner run of the belts to bring the image bearing surface thereon past the plurality of xerographic processing stations. Suitable drive means such as motor 17 are provided to power and coordinate the motion the various cooperating machine components whereby a faithful reproduction of the original input scene information is recorded upon a sheet of final support material 30, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image. The exposure station 21 may comprise a bundle of image transmitting fiber lenses 22 produced under the tradename of "SELFOC" by Nippon Sheet Glass Company Limited, together with an illuminating lamp 24 and a reflector 26. After exposure of the belt 14 the electrostatic latent image recorded on the photoconductive surface 15 is transported to development station 27, wherein developer is applied to the photoconductive surface 15 of the belt 14 rendering the latent image visible. Suitable development station could include a magnetic brush development system including developer roll 28, utilizing a magnetizable developer mix having course magnetic carrier granules and toner colorant particles.

Sheets 30 of the final support material are supported in a stack arrangement on elevated stack support tray 32. With the stack at its elevated position, the sheet separator segmented feed roll 34, feeds individual sheets therefrom to the registration pinch roll pair 36. The sheet is then forwarded to the transfer station 37 in proper registration with the image on the belt and the developed image on the photoconductive surface 15 is brought into contact with the sheet 30 of final support material within the transfer station 37 and the toner image is transferred from the photoconductive surface 15 to the contacting side of the final support sheet 30 by means of transfer corotron 38. Following transfer of the image, the final support material which may be paper, plastic, etc., as desired, is separated from the belt by the beam strength of the support material 30 as it passes around the arcuate face of the belt tracking shoe 18, and the sheet containing the toner image thereon is advanced to fixing station 39 wherein roll fuser 40 fixes the transferred powder image thereto. After fusing the toner image to the copy sheet, the sheet 30 is advanced by output rolls 42 to sheet stacking tray 44.

Although a preponderance of toner powder is transferred to the final support material 30, invariably some residual toner remains on the photoconductive surface 15 after the transfer of the toner powder image to the final support material. The residual toner particles remaining on the photoconductive surface after the transfer operation is removed from the belt 14 by the cleaning station 46 which comprises a cleaning blade 47 in scrapping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by a cleaning brush as is well known in the art.

Normally when the copier is operated in the conventional mode, the original document 52 to be reproduced is placed image side down upon a horizontal transport viewing platen 54 which transports the original past the exposure station 21. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can embody the apparatus in accordance with the present invention.

Figure 3:
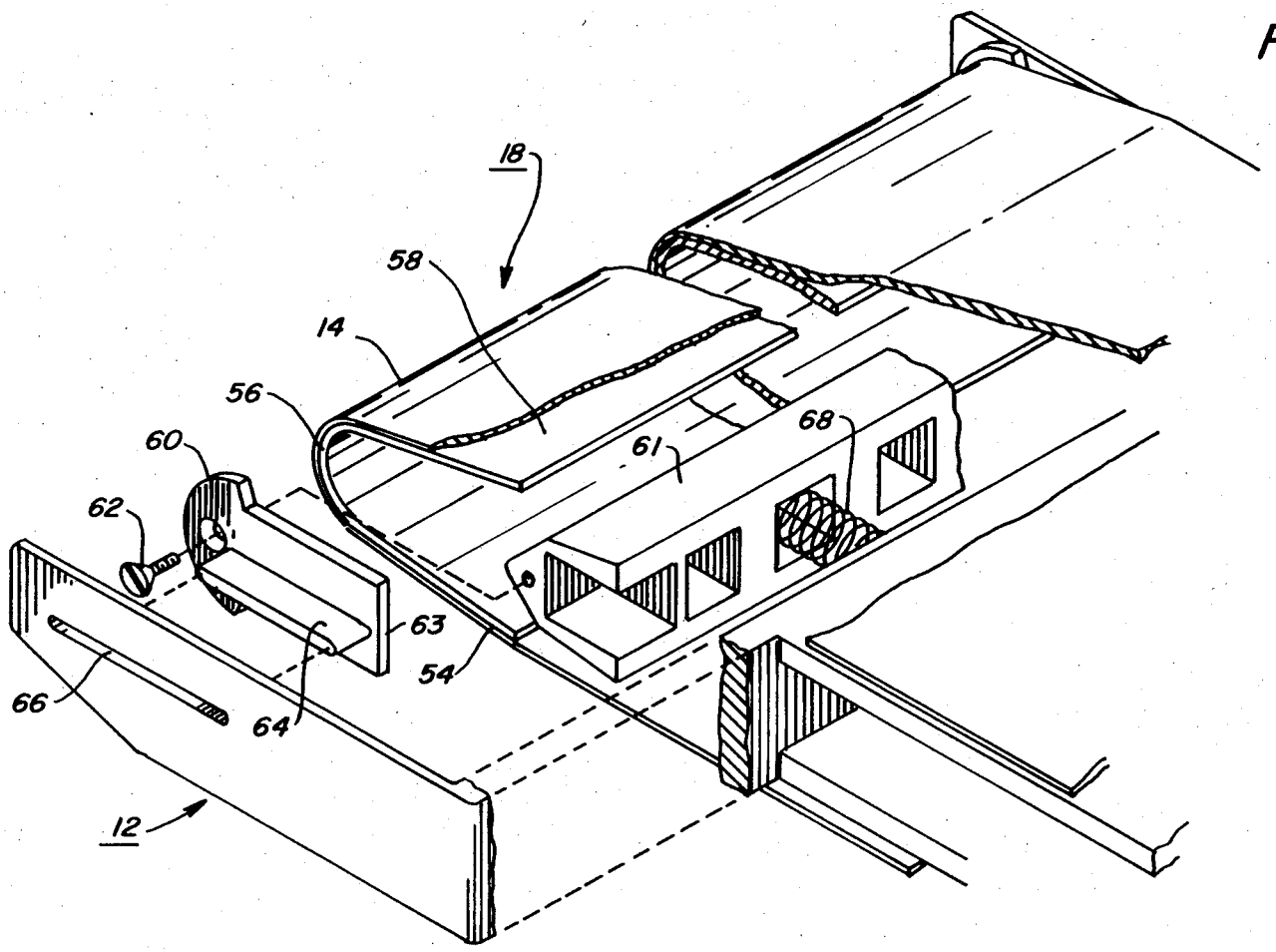
FIG. 3 is an exploded view of the belt tracking shoe.

The belt tracking shoe for controlling lateral movement of the belt according to the present invention will be described in greater detail with specific reference to FIGS. 2-5. With particular reference to FIG. 3, the belt tracking shoe 18 comprises a first substantially horizontal path defining surface 54, an arcuate path defining surface 56, and a second substantially planar path defining surface 58 which may or may not be substantially parallel to the planar surface 54 which path is being continuous to enable the belt to be reversed in direction by being transported therearound. It will be understood, of course, that only the arcuate path defining surface 56 is required for the belt tracking surface, the planar surface 54 and 58 providing support and ease of the manufacture. The belt tracking surface itself should be relative smooth and hard as well as having a relatively low coefficient of friction. Typically the coefficient of friction of the tracking surface is less than 0.3 and always less than that of the driving roll. Typically the belt tracking surfaces may be made from shaped sheet metal or molded directly from plastic. To provide a hard surface the belt tracking shoes are preferably made from glass coated steel Teflon impregnated anodized aluminum or lubricated polycarbonate. Belt tracking shoe is supported by support assembly 61 in the interior thereof which may be fastened to planar and arcuate surfaces by any suitable means such as screws, adhesive binding or snap fit. A single part can be injection molded using the above mentioned plastic which also includes the edge guides 60 to be hereinafter discussed. The planar and arcuate surfaces of the belt tracking shoe extend at least across the width of the belt to be transported therearound and include vertically oriented flange edge guide members 60 at opposed ends of the shoe forming edge guides for the belt when tracked around the shoe. Since the belt may walk in either axial (or lateral) direction depending on imperfections in the system geometry as previously discussed, these stationary edge guides are provided on both sides of the belt tracking shoe. The vertically oriented flange members 60 are supported by flange support 63 which is secured to the support assembly 61 by suitable means such as screws 62. The actual flange portion of the forming the edge guides would take the form of a crescent shape flange as indicated by segment terminated by lines A—A in FIG. 4. Both flange supports 63 are provided with slides 64 for mounting engagement with track 66 in the cartridge assembly 12 as shown in FIG. 3.

Figure 4:
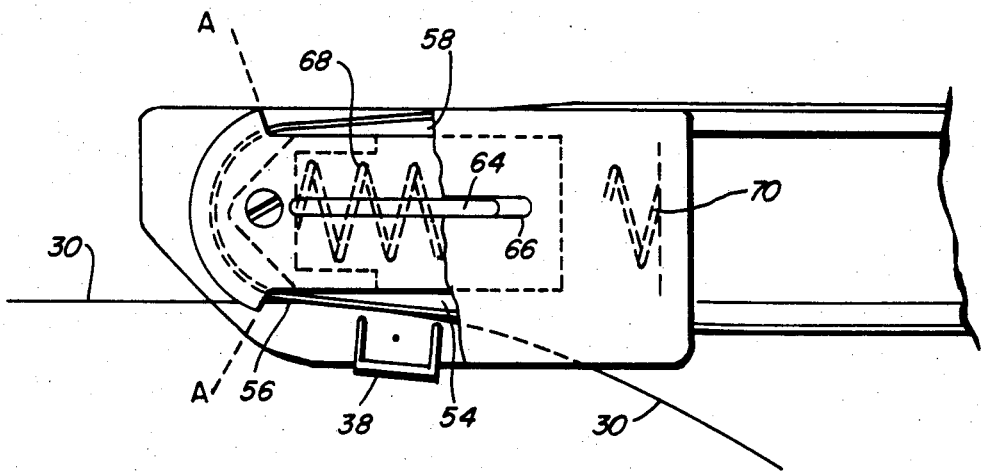
FIG. 4 is a further enlarged view of the belt tracking shoe in the cartridge showing the position of the transfer corotron relative to the platen portion and arcuate stripping of the copy sheet.
Figure 5:
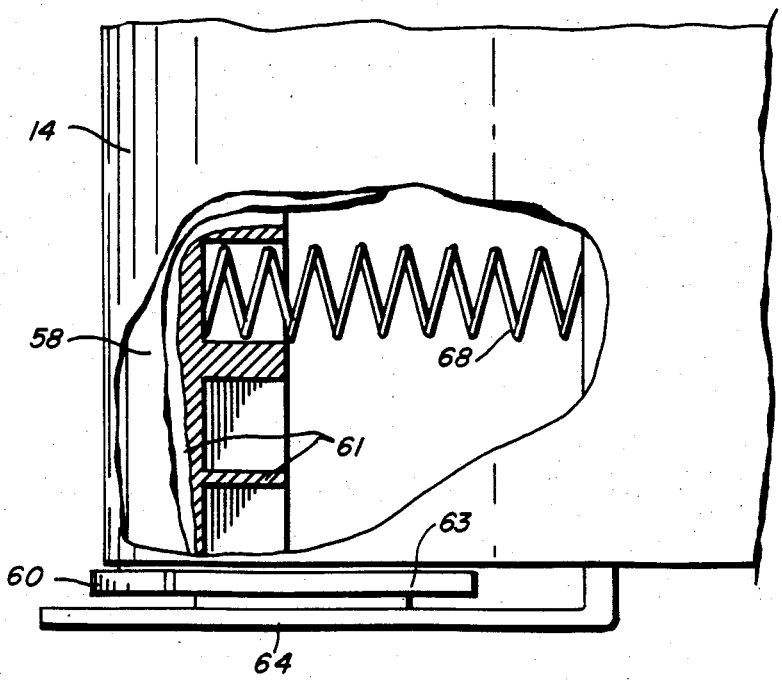
FIG. 5 is a sectional top view showing the spring mount of the belt tracking shoe.

The belt tracking shoe is urged toward the left in FIG. 4 to apply belt tensioning force by means of springs 68 which is supported at the inboard and outboard end by support member 70 in the cartridge frame. Also illustrated in FIG. 4 is a transfer corotron in opposed transferring relationship with the first planar portion 54 to enable transfer of the toner image on the belt 14 to a sheet of copy paper which may be transported therebetween. In this configuration of planar portion 54 serves as a transfer platen in the copying apparatus. Further illustrated in dotted line in FIG. 4 is a copy sheet 30 being driven through the transfer zone in transfer relationship with the toner image on the photoconductive belt and stripping by virtue of its beam strength at the beginning of the arcuate portion 56 of the belt tracking shoe.

The operation of the belt tracking shoe for controlling lateral movement of the belt will be described with reference to FIG. 7. As the photoreceptor belt moves over the stationary non-rotating belt tracking shoe, the friction force vector due to the photoreceptor belt sliding on the tracking shoe acts in a direction parallel to the velocity vector of the belt motion. The major velocity component of the belt is in the direction it is driven around the belt tracking shoe and the major component of friction will be in that direction also. If and when the belt tends to move axially (or laterally) toward an edge guide, the belt will have a small component of velocity and resultant frictional force axially toward the edge guide. However, when the belt touches the edge guide, the velocity in the axial direction is zero, therefore, the frictional force in the axial direction due to the belt tracking shoe on the photoreceptor belt is or approaches zero. At this time the system geometry produces the only forces which need to be resisted by the edge guide and the belt tracking shoe provides no contribution to the edge force on the belt at the edge guide. This permits the force in the axial direction at the edge guide to be equal to the force imparted by the drive roll and as a result, the belt moves axially upon the drive roll to maintain its position with respect to the edge guide. In other words, an equilibrium is reached between the reaction forces at the edge guide and the walk inducing forces exerted on the belt by the system. In a typical photoreceptor belt the maximum edge force which can be tolerated without edge damage or buckling is of the order of 1.5 pounds.

Figure 7:
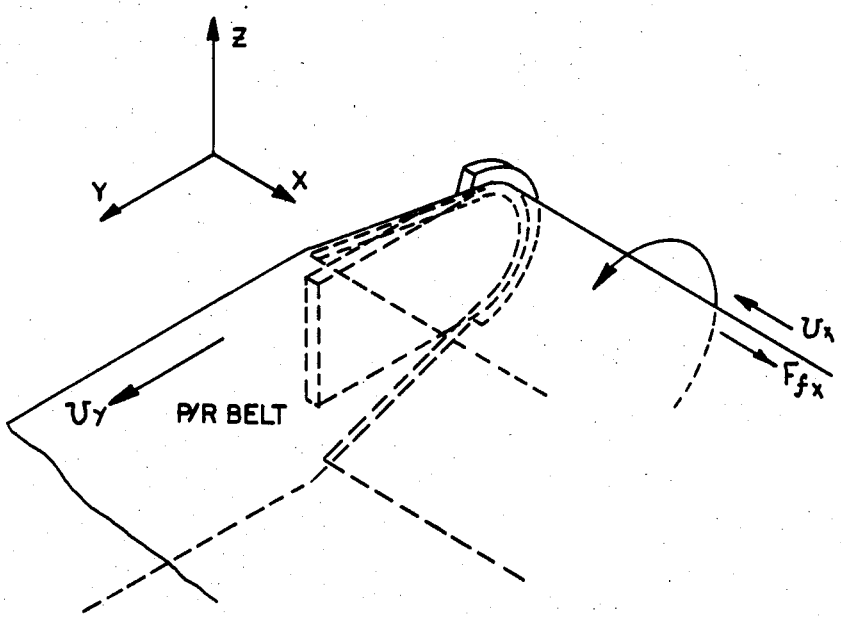
FIG. 7 is a schematic illustration of the belt movement about the belt tracking shoe.

With reference to FIG. 7, the belt velocity $\upsilon y$ is a constant, and when the belt touches the edge guide $\upsilon x=0$ and $F_{sx}$ between the tracking shoe and the belt approaches zero. As best understood at the present time the forces on the belt are equal to some function of the soft axis misalignment or twist of the photoreceptor frame (S.A.M.), roll conicity ($C_R$), photoreceptor conicity ($C_{P/R}$), belt tension and static friction force between the photoreceptor belt and the belt tracking shoe (u) and other components including the drive roll.

The present invention is in contrast and distinguishable from other passive belt tracking systems employing driven rolls or a driven and an idler roll wherein since the photoreceptor belt and roll are rotating at the same speed, there is a substantial friction component directed to the edge guide when the belt is constrained from moving axially by the edge guide. Furthermore in such tracking system since there are at least two rolls involved in the tracking system the above noted difficulties are encountered with each of the rolls. The present invention eliminates at least one rolls contribution to the frictional force which the edge guide would have to overcome in the two roll system since the present invention permits the belt to slip when the edge of it reaches the side edge guide.

Accordingly, the present invention provides a relatively simple, inexpensive belt tracking system being capable of tracking a belt for a long period of time without destroying the belt and having a considerable latitude in tracking the belt with respect to the functions that control the belt tracking. In addition, it is capable of providing a multifunctional device to enable belt tracking, transfer of the toner image from the belt to a copy sheet and self stripping. This is accomplished as indicated in the Figures by incorporating a transfer platen in the belt tracking shoe at the bottom of the shoe. It should be understood of course that this could be placed at the top of the shoe as well. It can also be used to enhance the copy sheet stripping by providing the appropriate radius of the tracking shoe at a position adjacent to the transfer platen.

Figure 6:
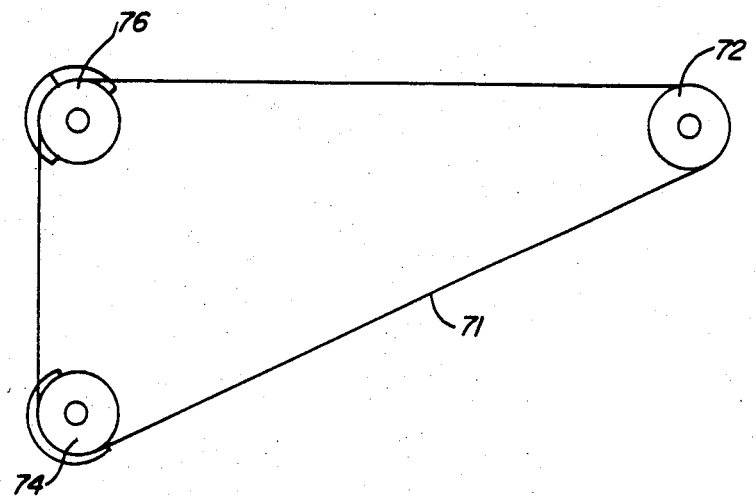
FIG. 6 illustrates an alternative photoreceptor embodiment using a belt tracking shoe.

FIG. 6 generally illustrates an alternative embodiment of the present invention wherein a belt 71 is driven by drive roll 72 around belt tracking shoe 76 and idler roll 74. Furthermore it provides increased reliability in a belt tracking system in that the opportunity for damage to the side edge of the belt by way of wrinkling or otherwise is substantially minimized.

The disclosures of the patents referred herein are hereby specifically and totally incorporated herein by reference.

While the invention has been described with reference to specific embodiments it will be apparent to those skilled in the art, that many alternatives, modifications and variations may be made. For example, while the belt tracking shoe has been described with reference to a photoreceptor belt, it will be understood that it may be used in other environments. Accordingly it is intended to embrace all such alternatives, modifications as may fall within the spirit and scope of the appended claims.

What is claimed is:

1. Apparatus for supporting a belt arranged to move in an endless predetermined path and for controlling the lateral movement of the belt from the predetermined path, said apparatus comprising a stationary non-rotating arcuate tracking shoe with a belt path defining surface for supporting a belt thereon, said tracking shoe including vertically oriented flanges at opposed sides of said path defining surface and extending from said path defining surface outwardly to provide belt edge guides.

2. The apparatus of claim 1, wherein said arcuate belt tracking shoe in the process direction has a first substantially planar path defining surface, an arcuate path defining surface to enable said belt to be reversed in direction when being transported therearound and a second substantially planar path defining surface.

3. The apparatus of claim 1, wherein the path defining surface of said belt tracking shoe is smooth, hard and has a low coefficient of friction.

4. The apparatus of claim 2, wherein said vertically oriented flanges are crescent shaped flanges extending from the path defining surface substantially only on the portion of the belt tracking shoe which changes belt direction.

5. Apparatus for transporting and tracking a belt arranged to move in an endless predetermined path and for controlling lateral movement of the belt from the predetermined path, comprising at least one rotatably driven belt transport roll, a belt tracking means and an endless belt arranged to move in a predetermined path around said at least one rotatably driven transport roll and said tracking means, said tracking means comprising a stationary non-rotatable arcuate tracking shoe with a belt defining surface for supporting a belt thereon and including vertically oriented flanges at opposed sides of said path defining surface and extending from said path defining surface outwardly to provide belt edge guides.

6. The apparatus of claim 5, wherein said arcuate belt tracking shoe in the process direction has a first substantially planar path defining surface, an arcuate path defining surface to enable said belt to be reversed in direction when being transported therearound and a second substantially planar path defining surface.

7. The apparatus of claim 5, wherein the path defining surface of said belt tracking shoe is smooth, hard and has a low coefficient of friction.

8. The apparatus of claim 6, wherein said vertically oriented flanges are crescent shaped flanges extending from the path defining surface substantially only on the portion of the belt tracking shoe which changes belt direction.

9. The apparatus of claim 5, wherein during movement of the belt by said drive roll around said tracking shoe the velocity of the belt in the axial direction of the tracking shoe is zero when the belt touches an edge guide and the friction force between the belt and the tracking shoe driving the belt toward said edge guide in the axial direction approaches zero.

10. The apparatus of claim 5, wherein said belt tracking means comprises at least two stationary non-rotating arcuate tracking shoes.

11. The apparatus of claim 5 including spring means urging said non-rotating arcuate tracking shoe to tension the belt.

12. The apparatus of claim 11, wherein said spring means includes springs on both axial ends of said tracking shoe.

13. Electrostatographic printing apparatus of the type having an endless photoconductive belt arranged to move in a predetermined path past a plurality of processing stations, said apparatus including means to transport said photoconductive belt and control lateral movement of said photoconductive belt from said predetermined path including at least one rotatably driven belt transport roll, a belt tracking means and an endless belt arranged to move in a predetermined path around said at least one rotatably driven transport roll and said tracking means, said tracking means comprising a stationary non-rotatable arcuate tracking shoe with a belt defining surface for supporting a belt thereon and including vertically oriented flanges at opposed sides of said path defining surface and extending from said path defining surface outwardly to provide belt edge guides.

14. The apparatus of claim 13, wherein said arcuate belt tracking shoe in the process direction has a first substantially planar path defining surface, an arcuate path defining surface to enable said belt to be reversed in direction when being transported therearound and a second substantially planar path defining surface.

15. Electrostatographic printing apparatus of claim 13, wherein the path defining surface of said belt tracking shoe is smooth, hard and has a low coefficient of friction.

16. Electrostatographic printing apparatus of claim 14, wherein said vertically oriented flanges are crescent shaped flanges extending from the path defining surface substantially only on the portion of the belt tracking shoe which changes belt direction.

17. Electrostatographic printing apparatus of claim 13, wherein during movement of the belt by said drive roll around said tracking shoe the velocity of the belt in the axial direction of the tracking shoe is zero when the belt touches an edge guide and the friction force between the belt and the tracking shoe driving the belt toward said edge guide in the axial direction approaches zero.

18. Electrostatographic printing apparatus of claim 13, including spring means urging said non-rotating arcuate tracking shoe to tension the belt.

19. Electrostatographic printing apparatus of claim 18, wherein said spring means includes springs on both axial ends of said tracking shoe.

20. Electrostatographic printing apparatus of claim 13, wherein said belt transport roll, photoconductive belt, and belt tracking means comprise a removable processing cartridge for mounting onto the frame assembly of the printing apparatus and including guide means on the vertical edge guide of said belt tracking shoe for slidingly supporting said belt tracking means in mounting means in the cartridge assembly.

21. Electrostatographic printing apparatus of claim 14 wherein one of said substantially planar path defining surfaces is adjacent the toner image transfer zone of said apparatus to provide a transfer platen.

22. Electrostatographic printing apparatus of claim 21 wherein said arcuate path defining portion provides means to strip copy sheets from the photoconductive belt.

* * * * *